United States Patent [19]

Gates et al.

[11] Patent Number: 4,758,257

[45] Date of Patent: Jul. 19, 1988

[54] GAS LIQUEFACTION METHOD AND APPARATUS

[75] Inventors: Robert G. Gates, Mendham, N.J.; John Marshall, Ascot, England

[73] Assignee: The BOC Group plc, Windlesham, England

[21] Appl. No.: 45,945

[22] Filed: May 1, 1987

[30] Foreign Application Priority Data

May 2, 1986 [GB] United Kingdom ..... 8610855

[51] Int. Cl.[4] ..... F25J 3/06

[52] U.S. Cl. ..... 62/23; 62/38

[58] Field of Search ..... 62/9, 11, 38, 39, 23, 62/24

[56] References Cited

U.S. PATENT DOCUMENTS

| | | | |
|---|---|---|---|
| 3,677,019 | 7/1982 | Olszewski | 62/9 |
| 3,874,185 | 4/1975 | Etzbach | 62/38 |
| 4,566,886 | 1/1986 | Fabian et al. | 62/23 |
| 4,595,405 | 6/1986 | Agrawal et al. | 62/38 |
| 4,606,744 | 8/1986 | Kundig | 62/38 |
| 4,619,679 | 10/1986 | Delong | 62/38 |
| 4,638,638 | 1/1987 | Marshall et al. | 62/514 R |
| 4,638,639 | 1/1987 | Marshall et al. | 62/514 R |
| 4,666,481 | 5/1987 | Olson, Jr. | 62/23 |

*Primary Examiner*—Ronald C. Capossela

*Attorney, Agent, or Firm*—R. Hain Swope; Larry R. Cassett

[57] ABSTRACT

A stream of compressed nitrogen (or methane) at above its critical pressure is passed along conduit 10 through heat exchangers 16, 18, 20, 22 and 24, in sequence, to cool it to below its critical temperature. The resulting fluid is then subjected to expansion and resultant liquid is collected. Refrigeration for the heat exchangers is provided by nitrogen working fluid cycles 62, 72 and 82 employing expansion turbines 64, 74 and 84 respectively. The turbines have different inlet temperatures but substantially the same outlet temperature.

14 Claims, 4 Drawing Sheets

300K
200K
150K
110K
Temp, K
0
ΔH
a
b
c
d
a and c
b and d
p
l
g
g'
h
h'

GAS LIQUEFACTION METHOD AND APPARATUS

BACKGROUND OF THE INVENTION

This invention relates to a refrigeration method and apparatus and is particularly concerned with the liquefaction of permanent gases such as nitrogen and methane.

Nitrogen and methane are permanent gases which cannot be liquefied solely by decreasing the temperature of the gas. It is necessary to cool it (at pressure) at least to a "critical temperature", at which the gas can exist in equilibrium with its liquid state.

Conventional processes for liquefying nitrogen or for cooling it to below the critical point typically require the gas to be compressed (unless it is already available at a suitably elevated pressure, generally a pressure above 30 atmospheres) and heat exchanged in one or more heat exchangers against at least one relatively low pressure stream of working fluid. At least some of the working fluid is provided at a temperature below the critical temperature of nitrogen. At least part of the stream or of each stream of working fluid is typically formed by compressing the working fluid, cooling it in the aforesaid heat exchanger or heat exchangers, and then expanding it with the performance of external work ("work expansion"). The working fluid is preferably taken from the high pressure stream of nitrogen, or this stream may be kept separate from the working fluid, which may nevertheless consist of nitrogen.

In practice, liquid nitrogen is stored or used at a pressure substantially lower than that at which the gaseous nitrogen is taken from isobaric cooling to below its critical temperature. Accordingly, after completing such isobaric cooling, the nitrogen at below its critical temperature is passed through an expansion or throttling valve whereby the pressure to which it is subjected is substantially reduced, and liquid nitrogen is thus produced together with a substantial volume of so called "flash gas". The expansion is substantially isenthalpic and results in a reduction in the temperature of the nitrogen being effected.

Generally, the thermodynamic efficiency of a conventional commercial process for liquefying nitrogen is relatively low and there is ample scope for improving such efficiency. Considerably emphasis in the art has been placed on improving the total efficiency of the process by improving the efficiency of heat exchange. Much analysis has been done of the temperature differences between the respective streams at various points in the heat exchangers to determine the overall thermodynamic efficiency of the heat exchange.

Our approach not only involves improving the efficiency of heat exchange but extends to providing a drastic reduction in the total heat duty of the exchangers, and extends further to improving the performance of the working fluid cycles as well. It is known in nitrogen liquefiers to employ two or more such working fluid cycles providing refrigeration over temperature ranges which are mutually adjacent but do not overlap, the so-called "series" configuration. See, for example, our U.S. Pat. Nos. 4,638,639 and 4,638,638. Thus in a series configuration a "warm turbine working fluid cycle" might involve refrigerating the product stream from 200K to 160K, an "intermediate turbine working fluid cycle" might refrigerate the product stream from 160K to 130K, and a "cold turbine working fluid cycle" might continue the cooling from 130K to 100K.

It is also possible to use just two turbines in a series arrangement, one turbine being part of a 'warm turbine working fluid cycle' the other turbine being part of a 'cold turbine working fluid cycle'. The adjectives 'cold', 'intermediate' and 'warm' as applied herein to turbines refer to the relative inlet temperatures of the turbines.

SUMMARY OF THE INVENTION

According to the present invention there is provided a method of liquefying a stream of permanent gas comprising nitrogen or methane, including the steps of reducing the temperature of the permanent gas stream at elevated pressure to below its critical temperature, and performing at least two nitrogen working fluid cycles to provide at least part of the refrigeration necessary to reduce the temperature of the permanent gas to below its critical temperature, each such nitrogen working fluid cycle comprising compressing the permanent gas, working fluid, warming the work expanded nitrogen working fluid by heat exchange countercurrently to the said stream of nitrogen, refrigeration thereby being provided for the permanent gas stream, wherein in at least one nitrogen working fluid cycle, work expansion starts at a higher temperature than it does in at least one other nitrogen working fluid cycle, and wherein in each working fluid cycle, the temperature of the nitrogen working fluid at the end of work expansion is the same or substantially the same as such temperature in the other working fluid cycle(s).

We have discovered that the effectiveness of the warm and intermediate turbine working fluid cycles is surprisingly improved by having the temperature at the end of work expansion at a sub-critical level. Further, we have found it to be of great benefit to have the state of the working fluid at or near saturation at the end of expansion in a warm or intermediate working fluid cycle (as well as in a cold working fluid cycle). Moreover, our investigations have shown that the effectiveness of these cycles is enhanced by keeping the turbine outlet pressures high.

A further discovery of ours is that the effectiveness of the warm turbine working fluid cycle tends to increase with decreasing temperatures at the start of the work expansion. The optimum temperature at which to start the expansion of the nitrogen in said chosen nitrogen working cycle typically depends on how refrigeration is provided between ambient temperature and the upper temperature limit on the provision of net refrigeration by the working fluid cycles (the upper temperature limit equating the highest temperature at which nitrogen working fluid is taken for work expansion.) In conventional liquefiers of nitrogen, Freon (registered trade mark) refrigerant is preferably employed in Hankine refrigeration cycles to provide refrigeration between ambient temperature and 210K. It is found that below 210K the efficiency of such a refrigeration cycle falls rapidly with decreasing temperature. We believe that the temperature range over which such Freon refrigeration cycles operate can be extended by substituting for them a refrigeration cycle employing a mixed refrigerant. The mixed refrigerant may comprise a mixture of hydrocarbons or Freons (or both). Typically, therefore, when employing a mixed refrigerant, refrigeration for the nitrogen stream may be provided between ambient temperature and a temperature in the range of 175 to 190K. For example, it may be 185K or 175K. Accordingly, work expansion in the warm turbine working fluid cycle may start at a temperature in the range 175 to 190K. Moreover, in order to create the necessary temperature reduction by work expansion in the warm working fluid cycle, we prefer to start work expansion at a pressure of at least 75 atmospheres and more preferably at a pressure of from 80 to 90 atmospheres.

Our studies have shown that these discoveries of ours are best employed to the benefit of overall liquefier efficiency if the nitrogen working fluid at the end of each work expansion is at the same sub-critical temperature, in the range of from 110K to 126K and preferably at the same pressure, particularly if the fluid is saturated, although it is possible for the temperatures to be in a range spanning two degrees kelvin being bounded at its lower end by the saturation temperature. Such an arrangement differs from the "series" configuration in that although the highest temperature over which each trubine working fluid cycle provides refrigeration to the product stream is different from the highest temperature in each and every other cycle, the lowest temperature of refrigeration provision is substantially the same for all cycles.

We have shown that this preferred arrangement of turbine working fluid cycles, which we term "parallel", results in a dramatic reduction of the heat duty of the main heat exchangers in the liquefier compared to that in a comparably "series" case. With the warm turbine working fluid cycle operating in accordance with our invention, the refrigeration that needs to be provided to the stream to be liquefied by the colder working fluid cycle(s) is reduced substantially. This substantial reduction in turn reduces the refrigeration that would otherwise be needed for the working fluid supplied to the turbine inlet(s) for the cooler working fluid cycle(s). Said reduction in refrigeration requirement reduces the heat duty of the warmer heat exchangers drastically.

Preferably, either two or three nitrogen working fluid cycles are employed depending on the pressure of the permanent gas stream to be liquefied. The nitrogen in the stream to be liquefied will be preferably compressed to a pressure greater than its critical pressure, in which case, downstream of its refrigeration by means of said nitrogen working fluid cycles it is preferably subjected to at least three successive isenthalpic expansions, the resultant flash gas being separated from the resultant liquid after each isenthalpic expansion. The liquid from each isenthalpic expansion, save the last, is the fluid that is expanded in the immediately succeeding isenthalpic expansion, and at least some (and typically all) of the said flash gas is heat exchanged countercurrently with the nitrogen stream for liquefaction. Typically, after passing out of heat exchange relationship with the nitrogen stream to be liquefied, the flash gas is recompressed with incoming nitrogen for liquefaction. Preferably, the permanent gas stream may downstream of its refrigeration by the said nitrogen working fluid cycles be reduced in pressure by means of one or more expansion turbines, in addition to the fluid isenthalpic expansion stages.

BRIEF DESCRIPTION OF THE DRAWINGS

The method according to the invention will now be described by way of example with reference to the accompanying drawings, in which.

DETAILED DESCRIPTION

Figure 1:
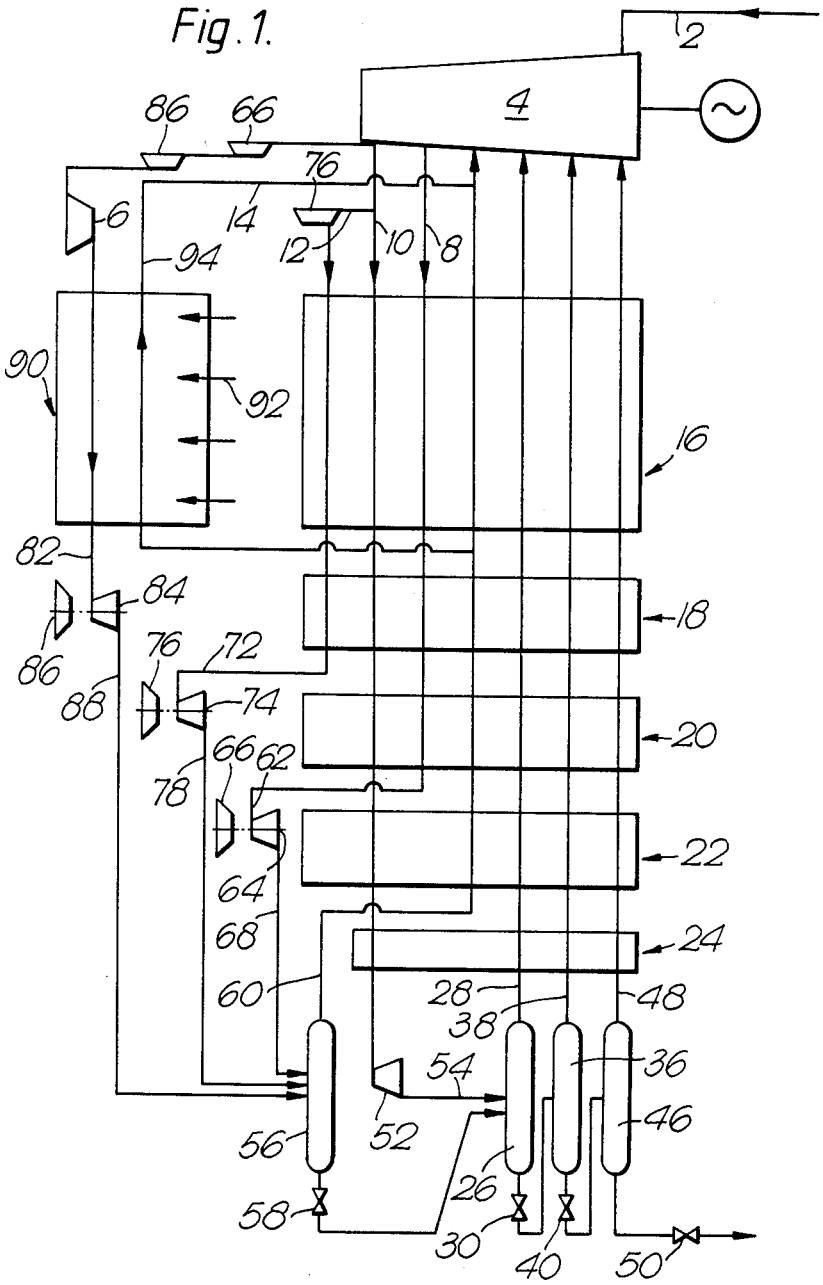
FIG. 1 is a schematic flow diagram illustrating a plant performing the method according to the invention.

Referring to FIG. 1 of the drawings, a feed nitrogen stream 2 is passed to the lowest pressure stage of a multistage rotary compressor 4. As the nitrogen flows through the compressor so it is in stages raised in pressure. The main outlet of the compressor 4 communicates (by means not shown) with conduit 10. Nitrogen at a pressure of about 50 atmospheres absolute, flows through the heat exchangers 16, 18, 20, 22 and 24 in sequence. This nitrogen stream to be liquefied is progressively cooled to a temperature below the critical temperature of nitrogen (and typically in the order of 122 to 110K). After leaving the cold end of the heat exchanger 24 the nitrogen is fed into an expansion turbine 52 in which it is expanded to a pressure below the critical pressure of nitrogen. The resulting mixture of liquid and vapour is passed from the outlet of the expansion turbine through conduit 54 into a first separator 26. The mixture is separated in the separator 26 into a liquid, which is collected therein, and a vapour stream 28. Liquid from the separator 26 is then passed through a first throttling or Joule-Thomson valve 30 to form a mixture of liquid and flash gas that is passed into a second phase separator 36 in which the mixture is separated into a flash gas stream 38 and a liquid which collects in the separator 36. Liquid from the separator 36 is passed through a second throttling or Joule-Thomson valve 40 and the resulting mixture of liquid and flash gas is in turn passed into a third phase separator 46 in which it is separated into a stream 48 of flash gas and a volume of liquid that is collected in the separator 46. Liquid is withdrawn from the separator 46 at a pressure 1.3 atmospheres absolute through an outlet valve 50.

Streams 28, 38 and 48 leaving the respective separators 26, 36 and 46 are each returned through the heat exchangers 24, 22, 20, 18 and 16 in sequence countercurrently to the flow of nitrogen in stream 10. After leaving the warm end of the heat exchanger 16 these nitrogen streams are each returned to a different stage of the compressor 4 and are thus reunited with the incoming feed gas 2.

It will be seen from FIG. 1 that all the refrigeration for the heat exchanger 24 is provided by the gas streams 28, 38 and 48, returning respectively from the separators 26, 36 and 46. Additional refrigeration for the heat exchangers 22, 20 18 and 16 is provided by three nitrogen working fluid cycles 62, 72 and 82.

The nitrogen compressor 4 has an outlet 8 for a first stream of nitrogen at a pressure of 43 atmospheres absolute providing the working fluid for the cycle 62 and expansion turbine 64. The booster compressor stage 66 is directly coupled to the expansion turbine 64 and absorbs the work produced by expansion of the working fluid. The booster stage 66 is connected into cycle 82 (for the sake of clarity the interconnecting pipework is omitted in FIG. 1).

For the working fluid cycle 72 nitrogen is supplied in conduit 12 at about 50 atmospheres absolute and its pressure is boosted in 76 before passing to the inlet of expansion turbine 74.

For cycle 82 the working fluid is supplied through conduit 14 from the 50 atmosphere absolute outlet from compressor 4. To attain the maximum level of working fluid to the inlet to expansion turbine 84 three booster stages are shown. There are the directly coupled booster stages 66 as above and 86 from turbine 84. In addition there is an electrically driven bridge compressor stage 6.

After work expansion in turbines 64, 74 and 84 the working fluid at or close to saturated condition is passed through conduits 68, 78 and 88 respectively to a guard separator 56. The working fluid vapour passing through separator 56 is fed through conduit 60 to the sequence of heat exchangers 22, 20, 18 and 16 and where it gives up refrigeration at it warms up prior to returning to an intermediate stage of the nitrogen compressor 4. The guard separator 56 is provided so that each or any of the expansion turbines 64, 74 and 84 may be permitted to operate close to saturation conditions but in practice with the possibility of there being some liquid at theoutlet, said liquid being collected in the guard separator 56 and passed through the throttling valve 58 to the separator chain 26, 36, 46.

It is seen in FIG. 1 that the inlet to turbine 64 is cooled in heat exchangers 16, 18 and 20 and the inlet to turbine 74 is cooled in heat exchangers 16 and 18, whereas the inlet to turbine 84 is cooled in heat exchanger 90. This latter is subjected to the maximum pressure in the working fluid circuit 82 and a Mixed Refrigerant System 92 supplies the extra refrigeration required to the warm end heat exchanger system comprising the heat exchangers 16 and 90. The flow through conduit 94 is regulated to balance heat exchanger 16.

Reference is now made to our prior statement that our invention compared to the conventional series arrangement for a liquefier provides a drastic reduction in the heat duty of the warmer exchangers. This reduction may be illustrated in the accompanying heat availability diagram of FIG. 2, which depicts the change in enthalpy as a function of temperature of all streams experiencing isobaric heating or cooling in the liquefier heat exchanger(s). Curves (a) and (b) pertain to our invention in which the working fluid cycles are arranged in parallel, curves (c) and (d) pertain to the series arrangement. As regards the parallel arrangement, curve (a) shows the sum of the changes in enthalpy relative to temperature for all streams that are being reduced in temperature. This sum is composed of the enthalpy changes in the stream of gas to be liquefied and in the feed streams for each of the turbine working fluid cycles. These feed streams, once admitted to the turbines to which they are connected, are no longer included in the enthalphy-temperature curve (a) shown on the diagram. Curve (b), also relating the parallel arrangement, shows the sum of the changes in enthalpy relative to temperatures for all streams which are increasing in temperature. This sum includes the enthalpy changes in each of the return streams from the turbines in each of the working fluid cycles and those enthalpy changes in all of the returning "flash gas" streams as well.

For convenience a zero level of enthalpy is assigned in the diagram to that point at which the lowest temperature depicted is encountered.

In a similar manner, curve (c) represents the sum of the changes in enthalpy for all streams which are being reduced in temperature in the series arrangement, and curve (d) represents the sum of the changes in enthalpy for all streams in which the temperature is being increased in the series arrangement. Also shown are enthalpy boundaries of the various heat exchangers depicted in FIG. 1. The temperature ranges of the exchangers 300 to 200K for exchanger 16 (FIG. 1), 200 to 150K for exchanger 18 and 150 to 110K for exchanger 20 were assigned arbitrarily equally to both the series and parallel arrangements, and do not reflect of necessity our preferred practice.

Figure 2:
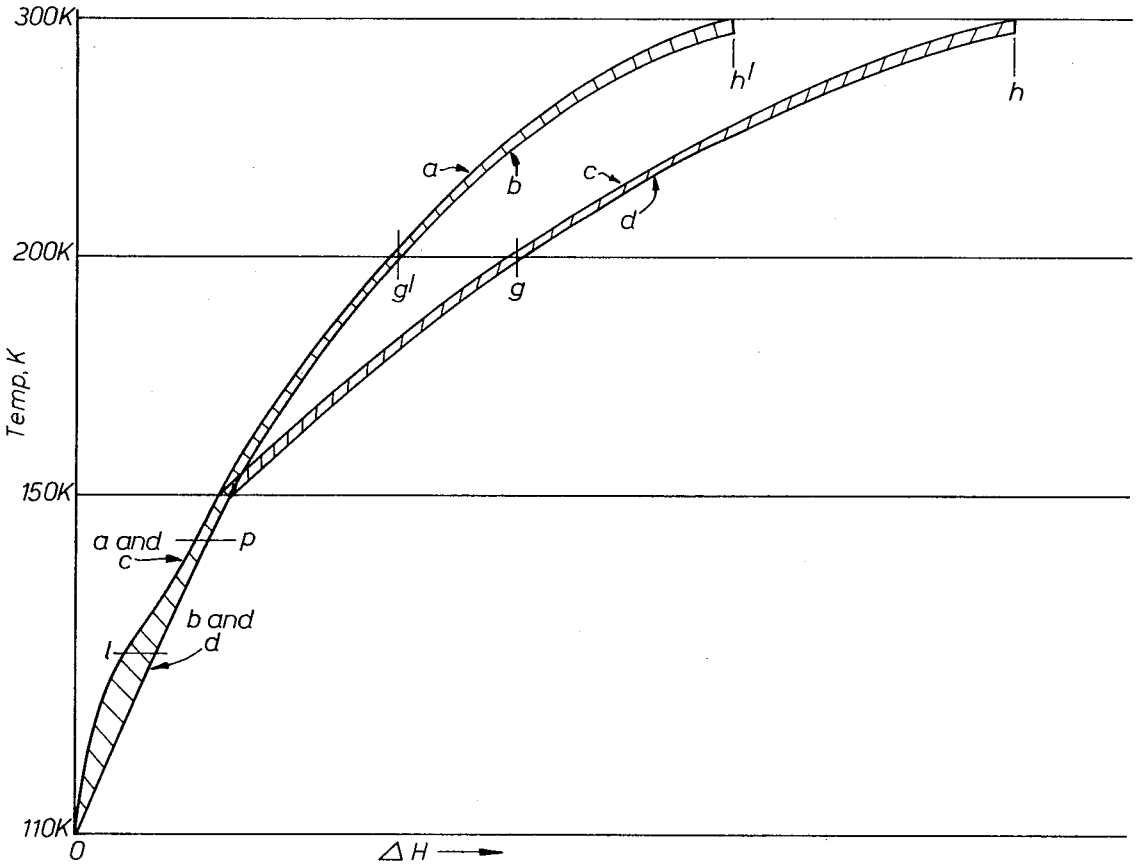
FIG. 2 is a heat availability chart illustrating the match between the temperature-enthalpy profile of the nitrogen stream to be cooled combined with the supply streams for the nitrogen working fluid in the working fluid cycles and that of the return nitrogen working fluid in the working fluid cycles combined with the "flash gas" returns.

Both the series and parallel arrangement curve sets shown in FIG. 2 are drawn to approximate scale and relate to liquefiers with the same rate of output of a liquefied product. The curves differ substantially, in that the curves (c) and (d) for the series arrangement extend from their zero value to a point at the 300K on FIG. 2, said point (h) representing a substantially greater overall change in enthalpy than the corresponding point (h') for the parallel arrangement, which is also located at 300K in the Figure. The enthalpy values which are the abcissae of points h and h' are, as is well known, the total heat duties of the exchangers which FIG. 2 represents. In the parallel case the total heat duty of the exchangers depicted is shown substantially less than that in the corresponding series arrangements.

Even more striking is the reduction in total heat duty experienced in exchanger 16 (see FIG. 1). In FIG. 2 the duty of exchanger 16 in the series case is shown as the enthalpy difference between points (g) and (h) on the Figure, while in similar fashion the enthalpy difference between points (g') and (h') represents this duty in the case of the parallel arrangement. By inspection it can be seen that the duty of heat exchanger 16 in the series case is well above that in the parallel.

Referring again to the schematic graph of FIG. 2; between the pairs of curves (a) and (b) and between curves (c) and (d) a cross-hatched area is shown. This area represents, to the scale of the Figure, the thermodynamic losses arising from the total heat exchange depicted in the Figure. It is known in the art that to reduce these losses the sum of the enthalpy changes in the streams in question should be altered so as to bring the curves as close to one another as possible, but not so close that at any point in the exchangers represented by the Figure the temperature difference between the two curves measured on a vertical line in the Figure is less than a preselected value which is set by the design of the exchangers, typically 2 Kelvin or less at a temperature of approximately 150K.

With regard to this thermodynamic losses arising from heat exchange in a liquefier, we believe in the case of our invention that these losses may be reduced to levels heretofore unattainable owing to a combination of features pertaining thereto. These features are (a) unusual flexibility provided for the regulation of the temperature-enthalpy relationship of the summed curves shown in FIG. 2 and (b) the aforementioned low overall heat duty of exchangers 16 and 18. These features will now be described in detail.

Figure 3:
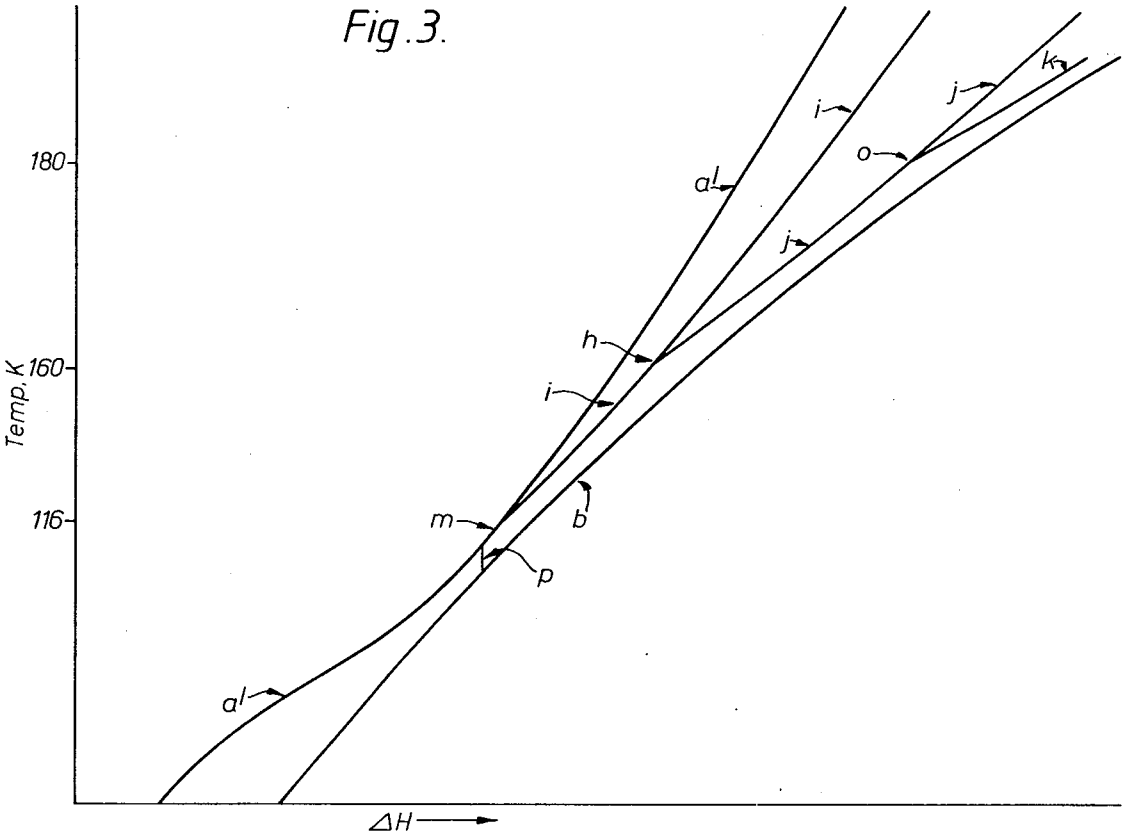
FIG. 3 is also a heat availability chart showing the contribution of the individual working fluid cycles to the temperature-enthalpy profile of the aforementioned combined cooling curve for the working fluid cycles and the product to be cooled.

Reference is made to FIG. 3, a schematic graph of the temperature-enthalpy curves for our parallel arrangement, much like curves (a) and (b) in FIG. 2, but now not drawn to scale. They are exaggerated in some dimensions so as to shown the features to be described more clearly. Curve (a') is the "cooling curve" only for the stream which provides the product and the "flash gas" return streams. Curve (b), as before, is the "warming curve" depicting the total enthalpy changes as a function of temperature of the sum of those changes in the turbine return streams and in the flash gas streams. Since in the preferred embodiment of our invention the outlet streams from each and every working fluid cycle turbine are at the same temperature and pressure, these streams may be combined into one return, shown as (b) in FIG. 3. In general, small deviations from uniformity of outlet pressure and temperature can be tolerated but only at the cost of loss of efficiency, particularly if a plurality of return streams that remain separate from one another is employed. The flow of such a stream may be adjusted in aggregate, reflecting as it does the sum of the individual working fluid cycle flows. This adjustment is first made so that the rate of rise of curve (b) in FIG. 3 will be such that this curve (b) will approach curve (a') as nearly as possible where the two curves are seen to be most nearly proximate (point (p)) but not so near as to violate the aforementioned condition that a minimal temperature difference will be maintained in all parts of each and every exchanger as outlined heretofore. This point of nearest proximity of the curves (a') and (b) will be called the "low temperature pinch".

It will now be seen that at temperatures above that of this low temperature pinch curves (a') and (b) diverge from one another. But curve (a') does not include the temperature-enthalpy profiles for the feed streams to the working fluid cycles. These streams must be chosen so that the resultant curve shall be as close to curve (b) as possible above the low temperature pinch point, subject, of course to the aforementioned condition of minimal temperature difference.

An advantage offered by the method according to the invention is that the flow rate in each working fluid cycle may be chosen independently of those in the others, subject only to the conditions that the sum of these flows be equal to that already determined as being required to bring curves (a') and (b) to appropriate proximity at the low temperature pinch point. Another advantage of the method according to the invention is that the temperature of working fluid entry to each turbine may be chosen independently of all others. In an embodiment of this invention involving three working fluid cycles there are five degrees of freedom available to allow the adjustment of the aforementioned resultant curve to a close proximity to curve (b) to limit the thermodynamic losses of heat exchange to very low levels. The making of this adjustment is facilitated by having the same temperature and pressure and the outlet of each turbine.

FIG. 3 shows how this adjustment is accomplished. Beginning at a point (m), somewhat above (p) in temperature, curve (i) represents the enthalpy-temperature relationship for the feed stream, represented by (a') and the stream which provides the fluid to the cold turbine working fluid cycle, the inlet to said cold turbine working fluid cycle, the inlet to said cold turbine being at the temperature at point (m) on the Figure. The flow represented by curve (i) is adjusted so that the temperature difference represented by the vertical distance between (i) and (b) is nowhere less than a predetermined amount. But (i), so oriented, is still divergent from (b) at higher temperatures, thus an intermediate turbine working fluid cycle, the feed to which added to those flows represented in curve (i) is represented by curve (j), beginning at point (n), point (n) is located on (i) at the temperature of intake to the intermediate turbine. Again the flow to the intermediate turbine working fluid cycle is chosen so that curves (j) and (b) are always vertically separate by at least the preselected minimal temperature difference. Finally curve (k) is drawn starting at point (o), said curve representing the totality of feed flows in the liquefier. Curve (a) in FIG. 2, then, is in fact curve (a') in FIG. 3 up to point (m), curve (i) between (m) and (h), curve (j) between (n) and (o), and curve (k) from (o) to the lowest temperature of refrigeration provided by the aforementioned Freon or mixed refrigerant cycle.

Figure 4:
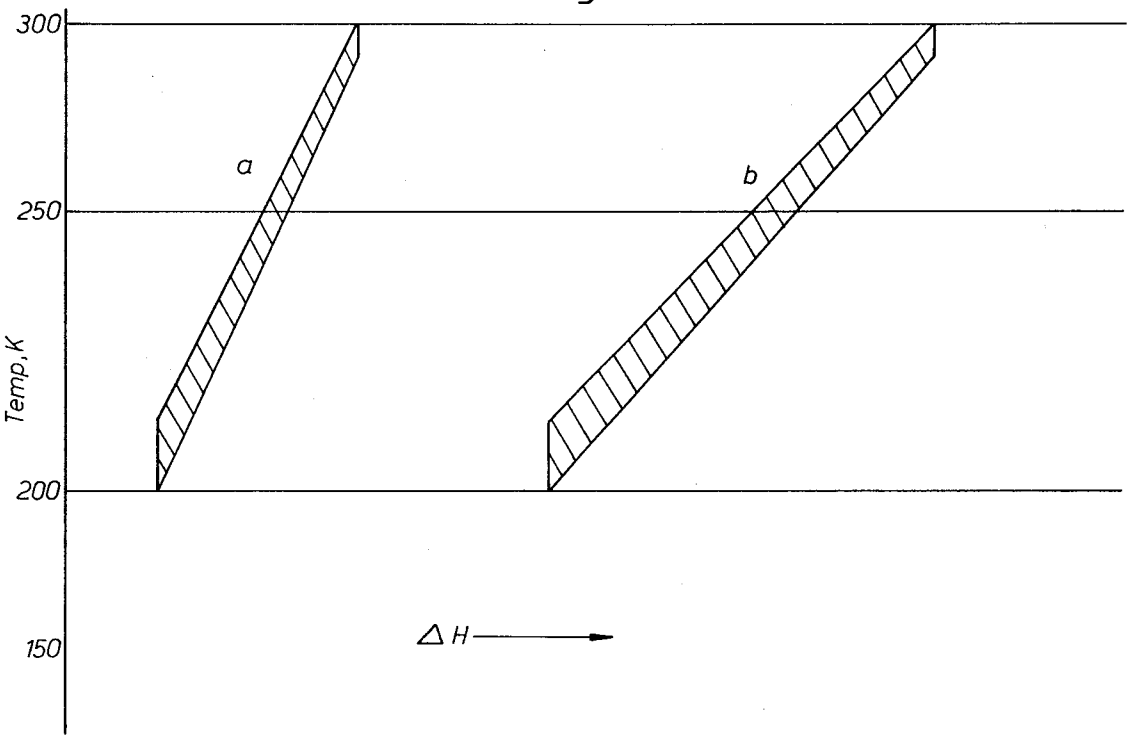
FIG. 4 is a schematic heat availability chart showing the effect of heat exchanger duty on the thermodynamic losses of heat exchange.

The fact, heretofore demonstrated, that our invention provides lower exchanger heat duty than available in the conventional series arrangement, is in and of itself a factor bringing the thermodynamic losses of heat exchange to unusually low levels. This can be seen in FIG. 4, also a schematic heat availability diagram, not to scale, wherein are represented two exchangers in which the temperature differences are mutually identical at all points but the heat duty of exchanger (b) is twice that of exchanger (a). Clearly the area between the curves in (a) is seen by inspection or through the use of well-known formulae of plane geometry to be half that occurring between the curves in (b) which by extension indicates that the thermodynamic losses in the (b) case are twice what they are in (a), resulting from the duty imposed on the exchanger.

Reference is made on again to FIG. 2. It will be noted that below the low temperature pinch point (p) curves (a) and (b) diverge from one another more than the degree of divergence above point (p). It has been held by others that it is of advantage from the standpoint of minimising the thermodynamic losses of heat exchange to bring these curves closer together below (p). The means to do this is by supplying additional refrigeration in an approximate range from point (p) down to point (1) on the diagram. We believe, to the contrary, that this is not advantageous, in that the aforementioned additional refrigeration imposes added heat duty above point (p), which added heat duty, as we have shown, increases the thermodynamic losses of these heat exchangers. This increase in loss, we believe counteracts the reduction in loss below point (p), to the degreee that it is likely to nullify it entirely.

As regards the number of working fluid cycles to be employed in our invention, our work has shown that this is largely dependent on the pressure of the nitrogen stream to be liquefied. At pressures of 50 atma and below we prefer the use of three such cycles, although under certain conditions two have been shown to be sufficient, while above 50 atma two such cycles are preferred.

In one embodiment of our invention, cooling a 50 atmospheres nitrogen stream, three working fluid cycles are employed. All the turbines have an outlet pressure of 15 to 16 atmospheres and an outlet temperature of 11.75K (at 16 atmospheres). The warm turbine working fluid cycle operates at a turbine inlet temperature in the 175K and 185K range, and an inlet pressure in the 80 to 90 atma range. The intermediate turbine working fluid cycle operates at a turbine inlet temperature in the 165K to 155K range and a turbine inlet pressure in the 60 to 65 atma range, and the cold turbine working fluid cycle operates at a turbine inlet temperature in the 150 to 140K range and a turbine inlet pressure in the 45 to 48 atma range.

Various changes and modifications may be made to the liquefier shown in FIG. 1 without departing from the invention. For example, the mixed refrigerant system 92 may be replaced by an alternative refrigeration system, such as one employing a single refrigerant. It is also possible to adapt the liquefier shown in FIG. 1 to liquefy methane rather than nitrogen. In such an example, nitrogen is still used as the working fluid in all the said working fluid cycles.

We claim:

1. In a process of liquifying a stream of permanent gas comprising nitrogen or methane comprising passing the stream at elevated pressure in countercurrent heat exchange with at least two nitrogen working fluid cycles thereby reducing the temperature of the stream to below its critical temperature, each such cycle comprising compressing nitrogen working fluid, cooling the fluid, work expanding the cooled fluid and warming the expanded fluid in heat exchange against said stream, the temperature of the cooled working fluid being different for each cycle, the improvement wherein the temperature of the expanded fluid is substantially the same for each cycle and said fluids are warmed in parallel against said stream.

2. A process in accordance with claim 1, wherein the temperature of the cooled nitrogen working fluid in one of said cycles is from about 175K to 190K.

3. A process in accordance with claim 1, wherein the pressure of the expanded fluid is substantially the same for each of said cycles.

4. A process in accordance with claim 3, wherein said expanded fluids of the cycle are combined prior to heat exchange warming against said stream.

5. A process in accordance with claim 1, wherein the pressure of the cooled fluid in one of said cycles is at least 75 atmospheres.

6. A process in accordance with claim 5, wherein the pressure of the cooled fluid in said cycle is from about 80 to 90 atmospheres.

7. A process in accordance with claim 1, wherein the expanded fluid in each of said cycles is in a saturated state.

8. A process in accordance with claim 1, wherein the temperature of the expanded fluid in each of said cycles is in the range of the saturation temperature of said fluid and two degrees kelvin thereabove.

9. A process in accordance with claim 1, wherein the temperature of the expanded fluid in each cycle is from 110 to 126K.

10. A process in accordance with claim 1, wherein the temperature of the cooled fluid in one of said cycles is from 175 to 190K.

11. A process in accordance with claim 1, including three nitrogen cycles.

12. A process in accordance with claim 1, wherein a portion of the cooling of the working fluid in at least one of said cycles is carried out in a heat exchanger other than the heat exchanger used to cool the permanent gas stream.

13. A process in accordance with claim 12, wherein said other heat exchanger is refrigerated with a mixed refrigerant.

14. A process in accordance with claim 1, wherein said permanent gas is nitrogen and the permanent gas stream and said working fluid are derived from a single feed stream.

* * * * *